US012018535B2

(12) United States Patent
Gao et al.

(10) Patent No.: US 12,018,535 B2
(45) Date of Patent: Jun. 25, 2024

(54) CONTINUOUS CONDUIT OPERATION APPARATUS

(71) Applicant: SHENZHEN UNIVERSITY, Guangdong (CN)

(72) Inventors: Mingzhong Gao, Guangdong (CN); Ling Chen, Guangdong (CN); Le Zhao, Guangdong (CN); Mingqing Yang, Guangdong (CN); Jianan Li, Guangdong (CN); Bo Yu, Guangdong (CN); Cong Li, Guangdong (CN); Zhiqiang He, Guangdong (CN); Yunqi Hu, Guangdong (CN); Guikang Liu, Guangdong (CN)

(73) Assignee: SHENZHEN UNIVERSITY, Guangdong (CN)

( * ) Notice: Subject to any disclaimer, the term of this patent is extended or adjusted under 35 U.S.C. 154(b) by 0 days.

(21) Appl. No.: 18/001,703

(22) PCT Filed: Dec. 4, 2020

(86) PCT No.: PCT/CN2020/133873
§ 371 (c)(1),
(2) Date: Dec. 13, 2022

(87) PCT Pub. No.: WO2022/021721
PCT Pub. Date: Feb. 3, 2022

(65) Prior Publication Data

US 2023/0235632 A1 Jul. 27, 2023

(30) Foreign Application Priority Data

Jul. 28, 2020 (CN) ..... 202010737003.9

(51) Int. Cl.
*E21B 19/22* (2006.01)

(52) U.S. Cl.
CPC ..... *E21B 19/22* (2013.01)

(58) Field of Classification Search
CPC ..... E21B 19/22; E21B 19/008; E21B 19/08
See application file for complete search history.

(56) References Cited

U.S. PATENT DOCUMENTS 3,841,407 A * 10/1974 Bozeman ..... E21B 19/22 226/173
4,249,600 A * 2/1981 Bailey ..... E21B 7/02 173/28

(Continued)

FOREIGN PATENT DOCUMENTS

CN 202370459 U 8/2012
CN 104100217 A 10/2014

(Continued)

*Primary Examiner* — James G Sayre
(74) *Attorney, Agent, or Firm* — MUNCY, GEISSLER, OLDS & LOWE, P.C.

(57) ABSTRACT

Disclosed is a continuous conduit operation apparatus, which comprises a folding frame and a guiding and injecting integrated mechanism configured to pull the conduit to go downwards a well or upwards a lifting direction. The folding frame comprises a base, a mounting frame connected to the base in a movable connection, and a telescopic mechanism configured to rotate the mounting frame in a vertical plane around a position of the movable connection. One end of the telescopic mechanism is movably connected to the base, another end of the telescopic mechanism is movably connected to the mounting frame. The guiding and injecting integrated mechanism is arranged on the mounting frame. The present disclosure integrates the guiding function and the injection function to reduce the height of the apparatus and is suitable for operation environment with limited space and height.

14 Claims, 13 Drawing Sheets

(56) References Cited

U.S. PATENT DOCUMENTS

| | | | | |
|---|---|---|---|---|
| 2015/0144357 | A1 | 5/2015 | Hampson et al. | |
| 2019/0169957 | A1* | 6/2019 | Hatalsky | F24T 10/13 |

FOREIGN PATENT DOCUMENTS

| | | | |
|---|---|---|---|
| CN | 105507833 | A | 4/2016 |
| CN | 111810066 | A | 10/2020 |
| CN | 111997541 | A | 11/2020 |
| CN | 112012681 | A | 12/2020 |
| CN | 212508155 | U | 2/2021 |
| CN | 212508156 | U | 2/2021 |
| CN | 212535587 | U | 2/2021 |

* cited by examiner

CONTINUOUS CONDUIT OPERATION APPARATUS

CROSS-REFERENCE TO RELATED APPLICATIONS

This application is a national stage application of PCT Patent Application No. PCT/CN2020/133873, filed on Dec. 4, 2020, which claims priority to Chinese Patent Application No. 202010737003.9, filed on Jul. 28, 2020, the content of all of which is incorporated herein by reference.

FIELD OF THE INVENTION

The present application relates to the technical field of underground exploration, in particular to a continuous conduit operation apparatus.

BACKGROUND

A continuous conduit operation is one of the techniques commonly used in exploration and development. Shown as FIG. 1, an existing continuous conduit work equipment typically comprises a guiding gooseneck (100) and an injector head (200), the guiding gooseneck is applied to guiding a continuous conduit to go into the injector head. A plurality of main functions of the injector head comprises:

(1) applying axial force to the continuous conduit to overcome the dead weight of the continuous conduit, as well as the buoyancy and the friction of the continuous conduit, providing sufficient pushing or pulling force to control well exiting or well entering movement of the continuous conduit;

(2) bearing the suspension weight of an entire continuous conduit when the continuous conduit is stationary;

(3) providing sufficient clamping force to prevent a relative sliding between the continuous conduit and a clamping block;

(4) controlling the lifting and lowering speed of the continuous conduit in a plurality of different conditions (5) providing a working platform for weight sensor and encoder;

(6) bearing the dead weight and an additional load of the entire continuous conduit.

In the prior art, an inlet of the injector head of a continuous conduit is locating directly above an outlet. When installing a wellhead equipment, the injector head locates right above a wellhead, having a shield to the wellhead to a certain extent, and bringing inconvenience to an installation of the wellhead equipment.

In addition, shown as FIG. 1, the injector head (200) itself has a certain height, together with a height of the guiding gooseneck (100), resulting in a height of an overall equipment very high, which is not suitable for a working environment having a limited space height (including a coal mine laneway, having a typical height no more than 3 m).

BRIEF SUMMARY OF THE DISCLOSURE

According to the defects in the prior art described above, the present application provides a continuous conduit operation equipment.

The technical solution of the present application to solve the technical problems is as follows:

A continuous conduit operation apparatus, which comprises a folding frame and a guiding and injecting integrated mechanism applied to pulling the conduit to go downwards in a well or upwards in a lifting direction; the folding frame comprises a base, a mounting frame connected to the base in a movable connection, and a telescopic mechanism applied to rotating the mounting frame in a vertical plane around a position of the movable connection;

one end of the telescopic mechanism is movably connected to the base, another end of the telescopic mechanism is movably connected to the mounting frame; the guiding and injecting integrated mechanism is arranged on the mounting frame.

Further, the continuous conduit operation apparatus comprises a drill rod driving device, the drill rod driving device is arranged on the mounting frame, and the drill rod driving device is located below the guiding and injecting integrated mechanism.

Further, the guiding and injecting integrated mechanism comprises a pair of sprocket and chain clamping assemblies, applied to clamping the continuous conduit and pulling the continuous conduit to go downwards in a well or upwards in a lifting direction; between the pair of sprocket and chain clamping assemblies, a conduit guiding channel applied for the continuous conduit to passing through is formed; an inlet and an outlet of the conduit guiding channel are not situated in a straight line.

Further, the conduit guiding channel is arc-shaped.

Further, each of the two sprocket and chain clamping assemblies comprises a sprocket set, a chain, a plurality of clamping blocks mounted on the chain, and a pushing plate applied to pressing the clamping blocks;

the pushing plate is an arc-shaped plate, both pushing plates of the two sprocket and chain clamping assemblies are concentrically arranged; and the pushing plate of at least one sprocket and chain clamping assembly has a clamping driving device connected, the clamping driving device is applied to driving the pushing plate to move in a radial direction;

the pushing plates of the two sprocket and chain clamping assemblies are applied to forming the conduit guiding channel between a certain number of the clamping blocks of the two sprocket and chain clamping assemblies, and making the certain number of the clamping blocks of the two sprocket and chain clamping assemblies clamp the conduit.

Further, a sprocket set of a sprocket and chain clamping assembly located at a periphery comprises a driving wheel, a tensioning wheel, and a driven wheel; a sprocket set of a sprocket and chain clamping assembly located in an inlier comprises at least a driving wheel and a driven wheel.

Further, the continuous conduit operation apparatus comprises a straightening apparatus, the straightening apparatus is applied to straightening the continuous conduit.

Further, the straightening apparatus comprises a bracket, a plurality of first rollers, a second roller, a crank arm, and a pressing hydraulic cylinder, the first rollers are at least two first rollers, and the first rollers are arranged in a straight line;

one end of the crank arm is movably connected to the bracket, the second roller is rotatably mounted at an inflection point of the crank arm, an output end of the pressing hydraulic cylinder is connected to another end of the crank arm to form a straightening channel between the first rollers and the second roller.

Preferably, the telescopic mechanism is a hydraulic telescopic mechanism.

Further, a bottom of the base has a crawler walking mechanism arranged.

Further, the continuous conduit operation apparatus further comprises a reel device, a continuous conduit and a movable base; the reel device comprises a reel, the reel is installed on a reel frame, the reel frame has a conduit-arrangement-device-assembly arranged, the conduit-arrangement-device-assembly is applied to controlling a wounding sequence of the continuous conduit; the reel is driven by a reel motor; and the reel frame is arranged on the movable base.

Compared with the prior art, the present application has a plurality of following beneficial effects:

1. The present application arranges the guiding and injecting integrated mechanism on the folding frame, that exposes the wellhead after folding the guiding and injecting integrated mechanism, thereby facilitating to install a wellhead device.
2. The present application integrates a guide function and an injection function together, being able to omit the guiding gooseneck, and reduce the height of the device effectively; especially being suitable for a working environment having a limited space height;
3. The present application arranges the straightening apparatus, being able to ensure no more under-well abrasion happen, while lowering the height of the device.

BRIEF DESCRIPTION OF THE DRAWINGS

The drawings described herein are applied to providing a further understanding of the embodiments of the present application, constituting a part of the present application, instead of a limitation to the embodiments of the present application.

DETAILED DESCRIPTION OF EMBODIMENTS

In order to make the purpose, technical solution and the advantages of the present application clearer and more explicit, further detailed descriptions of the present application are stated herein, referencing to the attached drawings and some embodiments of the present application. It should be understood that the detailed embodiments of the application described here are used to explain the present application only, instead of limiting the present application.

Embodiment I

Figure 1:
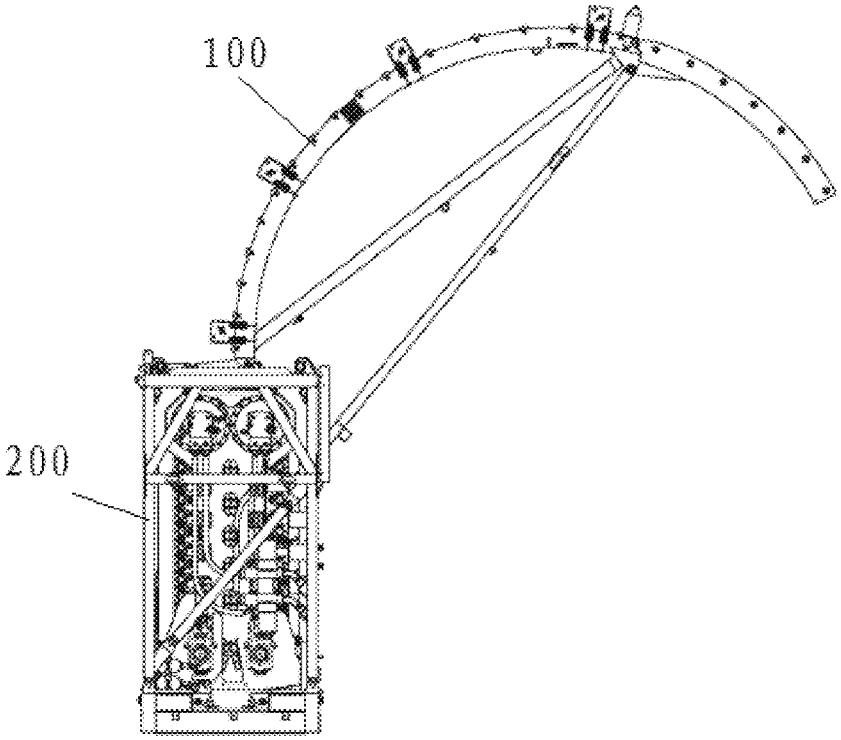
FIG. 1 illustrates a schematic structural diagram on the guiding gooseneck and the injection head in the prior art.
Figure 2:
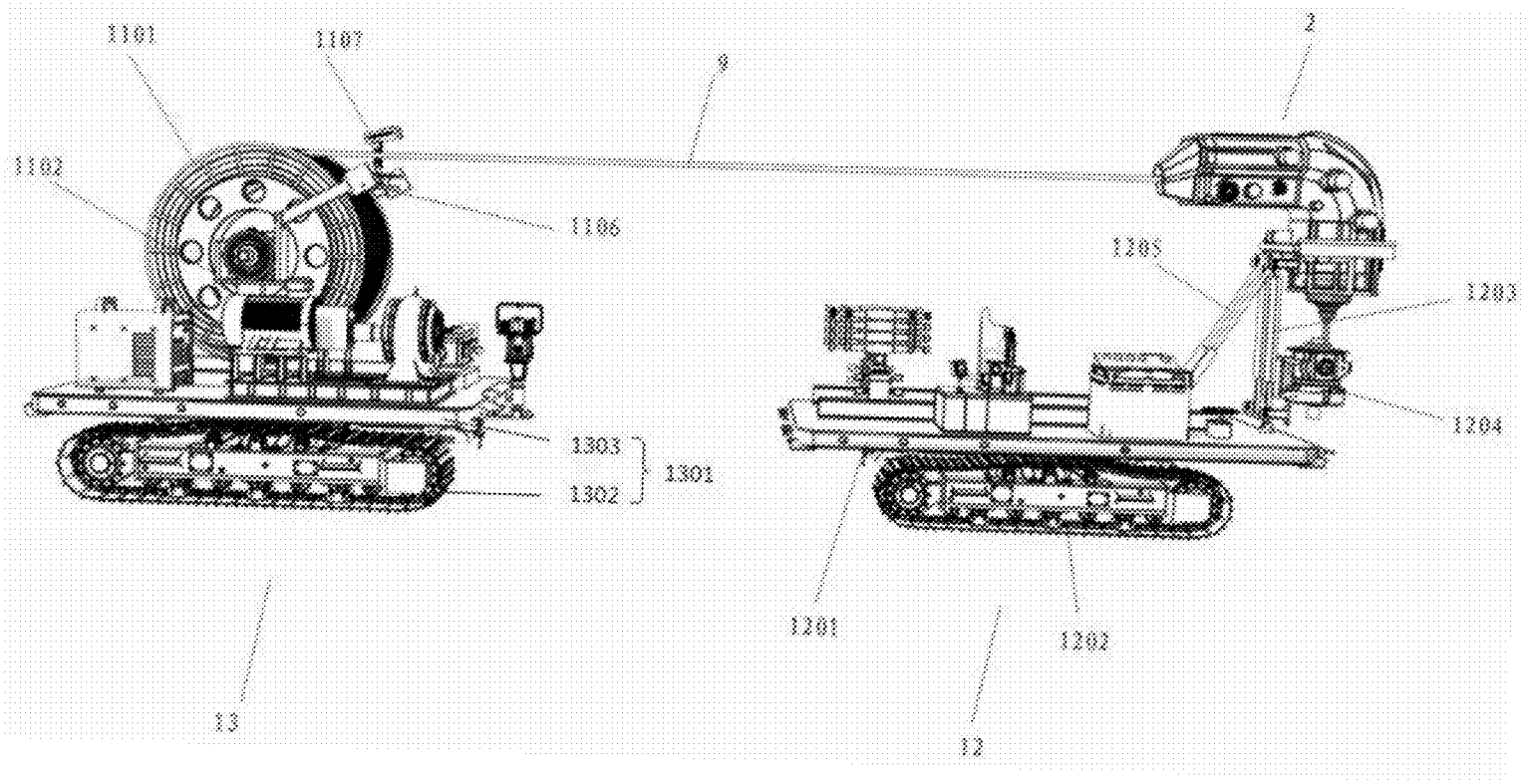
FIG. 2 illustrates a schematic structural diagram of the present application.
Figure 3:
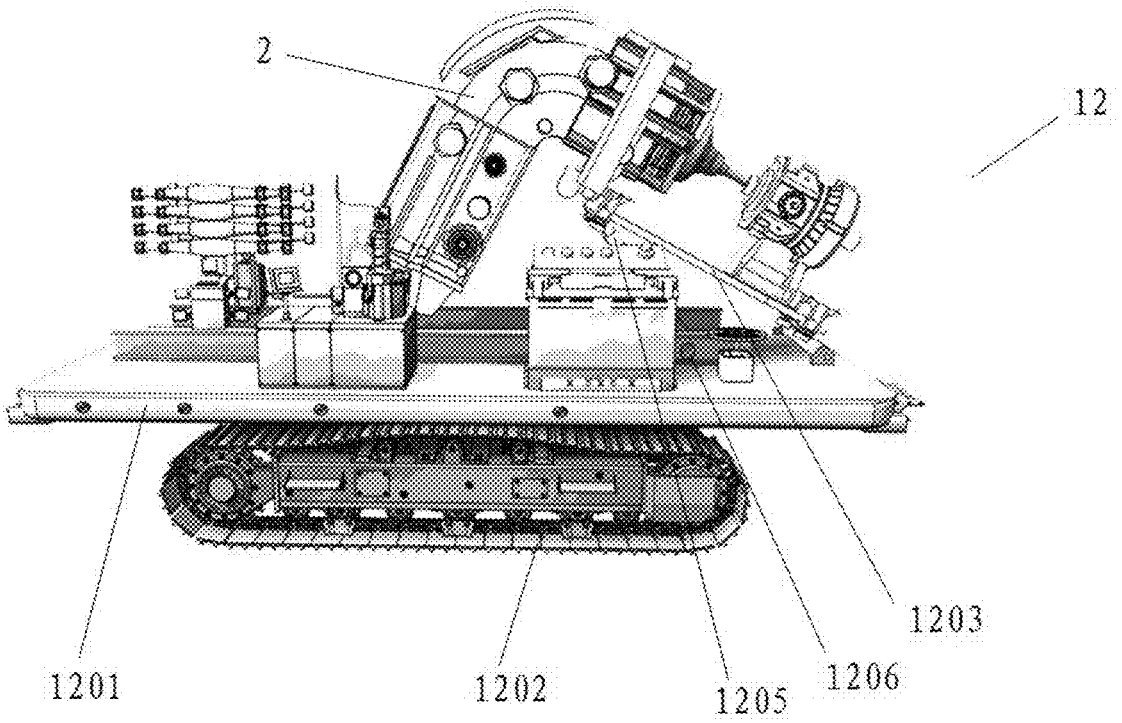
FIG. 3 illustrates a schematic diagram on a first working trolley when the folding rack is folded.

Shown as FIGS. 2 and 3, the present embodiment discloses a continuous conduit operation apparatus, which comprises a first work trolley 12, a second work trolley 13, and a continuous conduit 9.

The first work trolley 12 comprises a first crawler walking mechanism 1202, a folding frame, a drill rod driving device 1204, and a guiding and injecting integrated mechanism 2 applied to pulling the continuous conduit 9 to go downwards in a well or outwards a lifting direction.

The folding frame comprises a first base 1201, a mounting frame 1203 movably connected to the first base 1201, and a telescopic mechanism 1205 applied to rotating the mounting frame 1203 in a vertical plane around a movable connection, one end of the telescopic mechanism 1205 is movably connected to the first base 1201 through a hinge 1206, another end of the telescopic mechanism 1205 is movably connected to the mounting frame 1203.

There are a plurality of methods for a movable connection in the present technical field. In the present embodiment, a bottom of the mounting frame 1203 is hinged to the first base 1201, and by an extension or a retraction of the telescopic mechanism 1205, the mounting frame 1203 is able to rotate clockwise or counterclockwise around a hinge joint.

The first crawler walking mechanism 1202 is arranged on a bottom of the first base 1201. The guiding and injecting integrated mechanism 2 and the drill rod driving device 1204 are arranged on the mounting frame 1203. The drill rod driving device 1204 is located below the guiding and injecting integrated mechanism 2.

The second work trolley 13 comprises a reel device 1 and a movable base 1301, the movable base 1301 comprises a second base 1303 and a second crawler walking mechanism 1302, while the second crawler walking mechanism 1302 is arranged on a bottom of the second base 1303.

Figure 4:
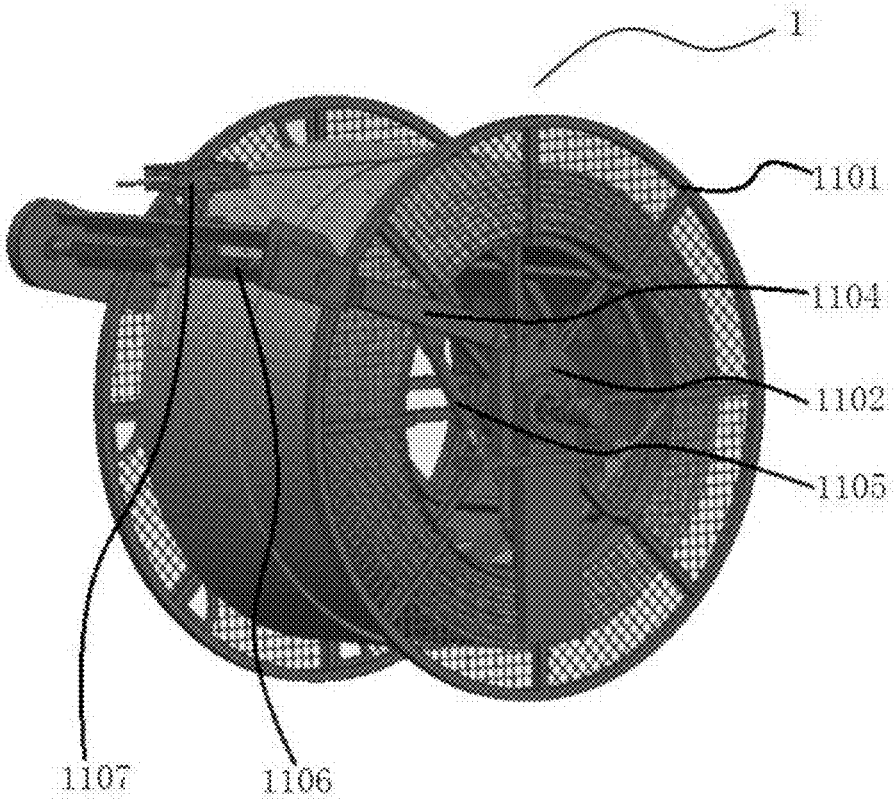
FIG. 4 illustrates a schematic view of a reel device.
Figure 5:
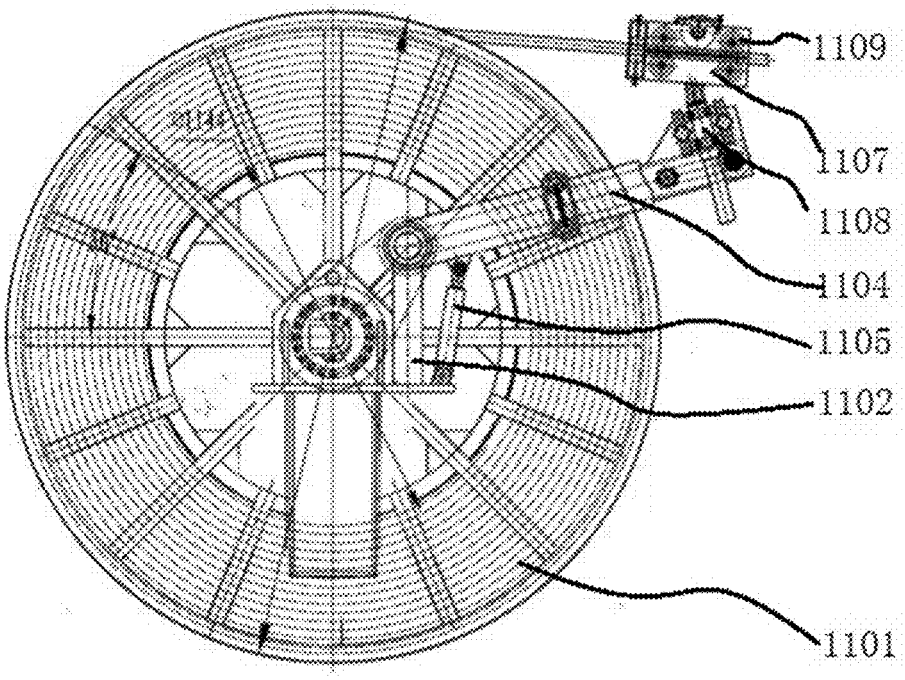
FIG. 5 illustrates a side view of the reel device.

As shown in FIG. 2, FIG. 4 and FIG. 5, the reel device 1 is arranged on the second base 1303 and applied to accommodating the continuous conduit 9. The reel device 1 comprises a reel 1101 and a reel frame 1102, the reel frame 1102 is arranged and fixed on the second base 1303, the reel 1101 is arranged on the reel frame 1102, and the reel frame 1102 has a conduit-arrangement-device-assembly arranged.

The conduit-arrangement-device-assembly comprises a conduit arrangement bracket 1104 and a torque limiting device. The conduit arrangement bracket 1104 connects to the reel frame 1102 rotably; a lifting hydraulic rod 1105 is arranged between the conduit arrangement bracket 1104 and the reel frame 1102; the conduit arrangement bracket 1104 has a bidirectional lead screw 1106 arranged; the bidirectional lead screw 1106 has a guiding device 1107 arranged. The guiding device 1107 has a mechanical counter and a rotating system arranged inside; the rotating system comprises a plurality of conveying wheels 1109. A lifting hydraulic cylinder 1108 is arranged between the guiding device 1107 and the bidirectional lead screw 1106. During a transmission process of the continuous conduit 9, the guiding device 1107 moves back and forth along the bidirectional lead screw 1106, making the continuous conduit 9 be neatly stored on the reel 1101.

The present application arranges the guiding and injecting integrated mechanism on the folding frame, after folding the guiding and injecting integrated mechanism, the wellhead will be exposed, thereby facilitating an installation of a wellhead device.

Figure 6:
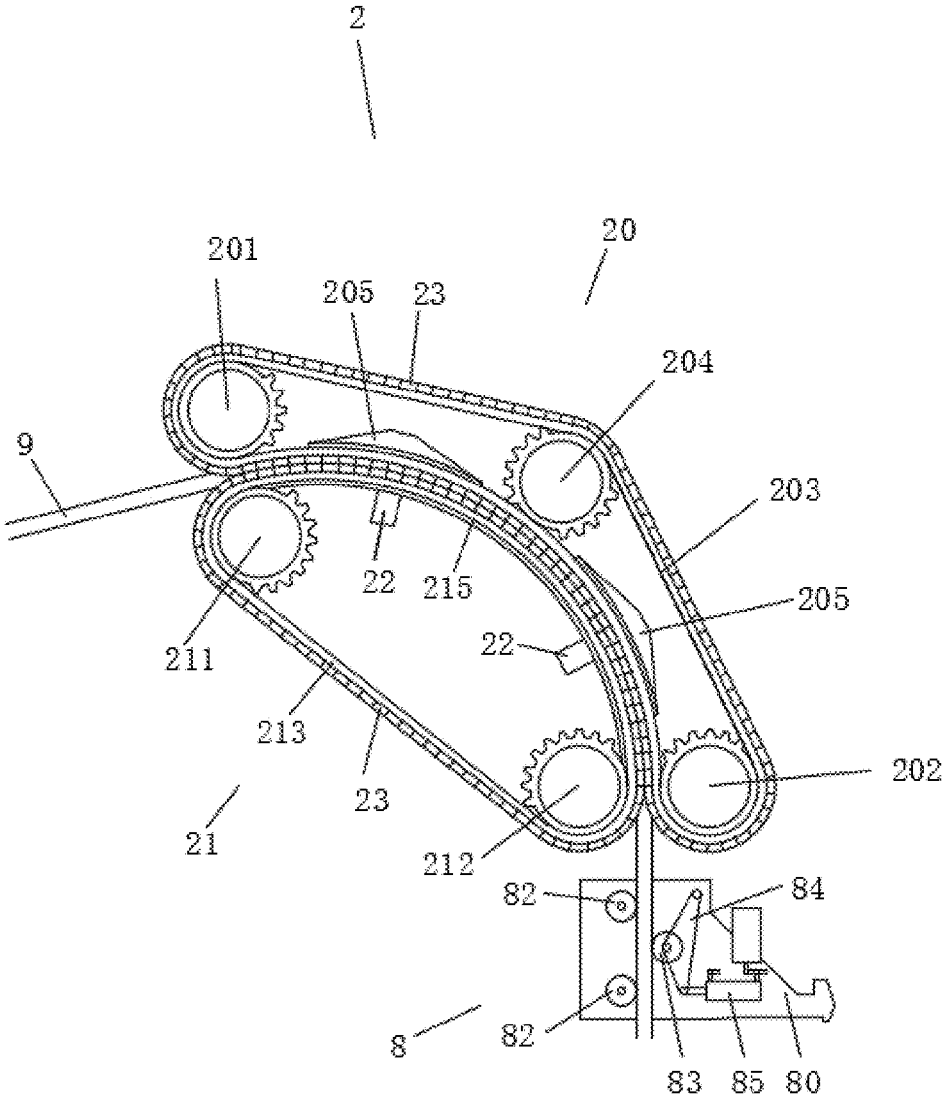
FIG. 6 illustrates a schematic structural diagram on a guide injection integrated mechanism and a straightening device in the Embodiment I.
Figure 7:
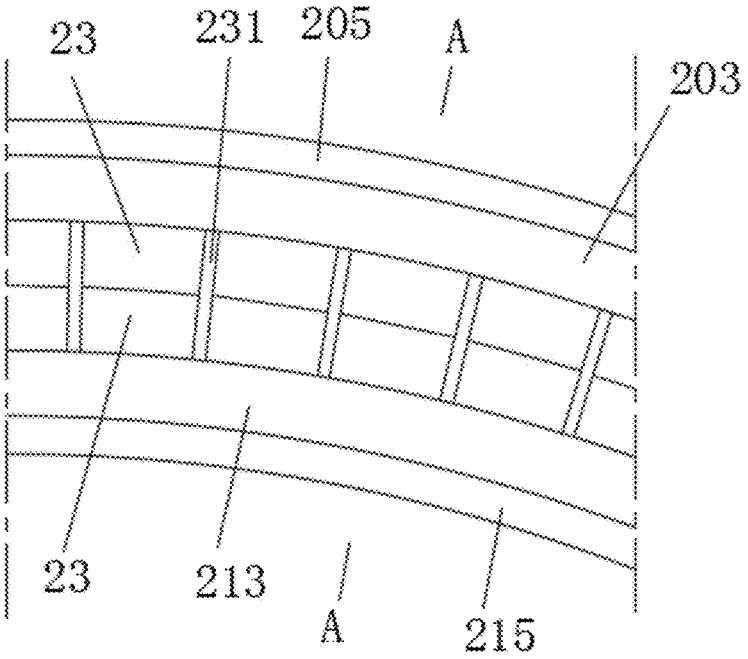
FIG. 7 illustrates a schematic diagram on a local position when a clamping block is clamping a conduit.

As shown in FIG. 6, in the present embodiment, the guiding and injecting integrated mechanism 2 comprises a first sprocket and chain clamping assembly 20 and a second sprocket and chain clamping assembly 21 that are applied to clamping the continuous conduit 9 and pulling the continuous conduit 9 to go downwards in a well or upwards in a lifting direction. Between the first sprocket and chain clamping assembly 20 and the second sprocket and chain clamping assembly 21, a conduit guiding channel applied for the continuous conduit to passing through is formed; an inlet and an outlet of the conduit guiding channel are not situated in a straight line.

In order to make a deformation of the continuous conduit smoother, the conduit guiding channel is arc-shaped.

In the present embodiment, the first sprocket and chain clamping assembly 20 comprises a first driving wheel 201, a first tensioning wheel 204, a first driven wheel 202, a first chain 203, a first pushing plate 205, and a plurality of clamping blocks 23 arranged on the first chain 203; the first driving wheel 201, the first tensioning wheel 204, and the first driven wheel 202 are not in a straight line, and the first chain 203 is engaged with the first driving wheel 201, the first tensioning wheel 204, and the first driven wheel 202.

The second sprocket and chain clamping assembly 21 comprises a second driving wheel 211, a second driven wheel 212, a second chain 213, a second pushing plate 215, and a plurality of clamping blocks 23 arranged on the second chain 213, while the second chain 213 is engaged with the second driving wheel 211 and the second driven wheel 212.

Both the first pushing plate 205 and the second pushing plate 215 are arc-shaped plates, the first pushing plate 205 and the second pushing plate 215 are arranged concentrically, and a radius of the first pushing plate 205 is larger than a radius of the second pushing plate 215.

Obviously, either of the first driving wheel 201 and the second wheel 211 has a traction motor connected. The first driving wheel 201, the first tensioning wheel 204, the first driven wheel 202, the second driving wheel 211, the second driven wheel 212 and the second chain 213 are all arranged on a rack, the rack connects to the mounting frame 1203. Either the traction motor or the rack is shown in the drawings, which is a conventional technique in the art and no more details are stated herein.

In the present embodiment, the second pushing plate 215 has a clamping driving device 22 connected, the clamping driving device 22 is applied to driving the second pushing plate 215 to move in a radial direction; and the clamping driving device 22 is a hydraulic cylinder.

The first pushing plates 205 and the second pushing plate 215 are applied to constructing a conduit guiding channel between a certain number of the clamping blocks 23 on the first chain 203 and a certain number of the clamping blocks 23 on the second chain 213, and making the certain numbers of the clamping blocks 23 on the first chain 203 and the second chain 213 clamp the continuous conduit 9.

Both an inner edge and an outer edge of the first tensioning wheel 204 in the present embodiment are engaged with the first chain 203. There is a first pushing plate 205 arranged between the first driving wheel 201 and the first tensioning wheel 204, as well as a first pushing plate 205 arranged between the first tensioning wheel 204 and the first driven wheel 202.

One end of the second pushing plate 215 in the present embodiment starts from the second driving wheel 211, another end of the second pushing plate 215 extends to the second driven wheel 212. Since the second pushing plate 215 has a longer arc, the second pushing plate 215 has at least two clamping driving devices 22 connected, to ensure a sufficient clamping strength.

As shown in FIGS. 6, 7, 8, and 9, the clamping blocks 23 are arranged on the chain one block by one block. There is a gap 231 between two adjacent clamping blocks 23. The first pushing plate 205 and the second pushing plate 215 make a plurality of the clamping blocks 23 be arranged along an arc direction, to form a conduit guiding channel 24, so as to achieve a guidance for the continuous conduit 9.

Clamping surfaces of the clamping blocks 23 on the first chain 203 and the second chain 213 have a certain radian at a guiding direction, so as to be in a surface contact with the continuous conduit 9, thereby increasing a clamping force and making a deformation of the continuous conduit 9 smoother.

Figure 8:
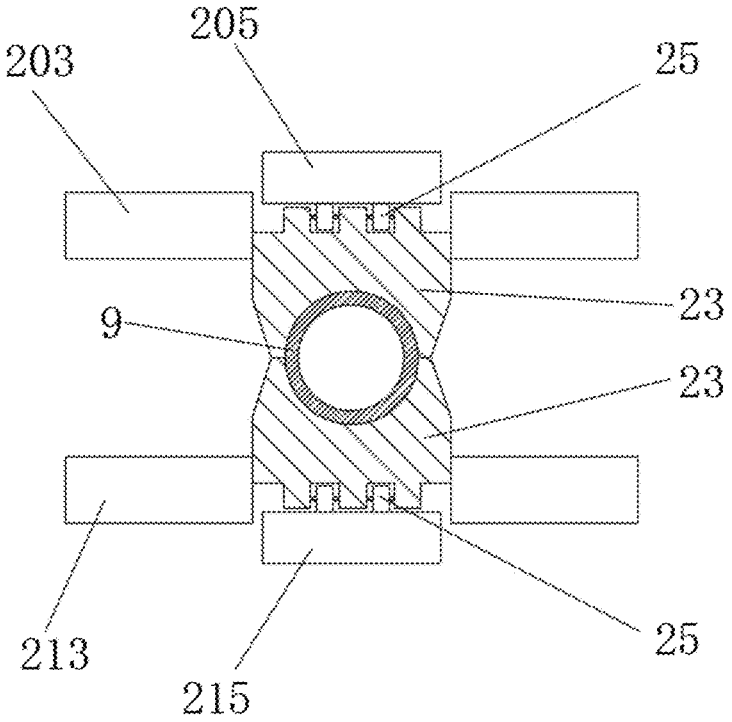
FIG. 8 illustrates a cross-section at A-A in FIG. 7.
Figure 9:
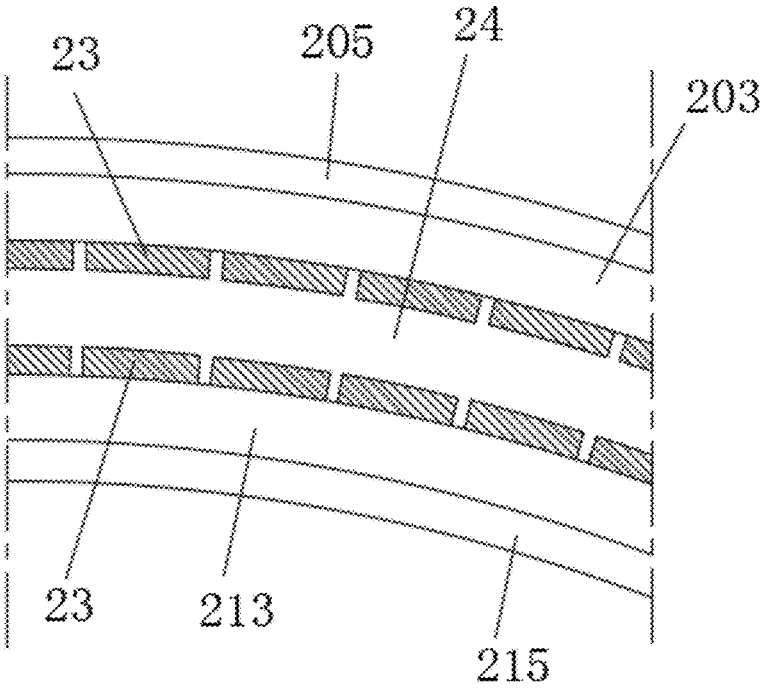
FIG. 9 illustrates a local schematic view on a conduit guiding channel.

Shown as FIG. 8, the clamping block 23 has a plurality of bearing rollers 25 arranged on, the first pushing plate 205 presses the bearing rollers 25 of the clamping blocks 23 on the first chain 203, and the second pushing plate 215 presses the bearing rollers 25 of the clamping blocks 23 on the second chain 213.

Obviously, the bearing rollers 25 may also be arranged on the pushing plates.

The conduit guiding channel 24 is arc-shaped, and when inserting a conduit, the continuous conduit 9 has a plastic bending and deformation at the conduit guiding channel 6, thus the continuous conduit 9 coming out of the conduit guiding channel 6 has a residual bend, and after going down the well, the residual bend will cause the continuous conduit 9 to have an eccentric abrasion with a well wall in the well, thereby increasing an under-well abrasion.

As shown in FIG. 6, the present application adds a straightening device 8 to straighten the continuous conduit 9, to eliminate the residual bend on the continuous conduit 9 in a maximum extent, which is conducive to ensuring that the continuous conduit 9 goes down the well vertically, being able to effectively reduce an under-well abrasion.

In the present embodiment, the straightening device 8 is selected as a roller straightening device. There are many roller straightening devices, and it is possible to be selected as desired.

Shown as FIG. 6, the straightening device 8 disclosed in the present application comprises a bracket 80, a first roller 82, a second roller 83, a crank arm 84, and a pressing hydraulic cylinder 85; the first roller 82 is arranged on the bracket 80, there are at least two of the first roller 82, and the first rollers 82 are arranged along a straight line. One end of the crank arm 84 is movably connected to the bracket 80, the second roller 83 is rotatably arranged at an inflection point of the crank arm 84, and an output end of the pressing hydraulic cylinder 85 is connected to another end of the crank arm 84 to enable the second roller 83 to press the continuous conduit 9, so as to form a straightening channel between the first rollers 82 and the second roller 83.

A working principle of the guiding and injecting integrated mechanism 2 in the present embodiment is as follows:

Shown as FIG. 6, a free end of the continuous conduit 9 passes between the clamping blocks 23 on the first chain 203 and the second chain 213;

the first pushing plate 205 and the second pushing plate 215 press the clamping blocks 23 on the first chain 203 and the second chain 213, making the clamping blocks 23 clamp the continuous conduit 9;

the first driving wheel 201 and the second driving wheel 211 rotate to drive the first chain 203 and the second chain 213 to move, followed by driving the clamping blocks 23 to move, that makes the continuous conduit 9 clamped between the clamping blocks 23 go downwards in a well or upwards in a lifting direction;

the continuous conduit 9 coming out of the conduit guiding channel goes directly downwards the well after being straightened by the straightening device 8.

The guiding and injecting integrated mechanism in the present embodiment integrates a guiding function and an injection functions into a whole, while further arranging the straightening device together, so that at a same time of lowering a height of a device effectively, it can be ensured that no more under well abrasion will happen. The present application is particularly suitable for an operating environment having a limited space height, including a work in a coal mine roadway.

China is not only a big country producing coal, but also a big country consuming the coal, thus the coal is an important basic energy and raw material for China. The content of coal seam gas and the pressure of coal seam gas are main indexes of predicting an outburst risk area and inspecting a regional effect in outburst coalbed, while the coal seam gas content is usually measured by adopting a plurality of methods including surface coalbed methane determination, coalbed gas content measurement, borehole and core-taking of underground coal seam, and more. A core-taking device in the prior art is typically composed by an inner conduit assembly and an outer conduit assembly.

Figure 10:
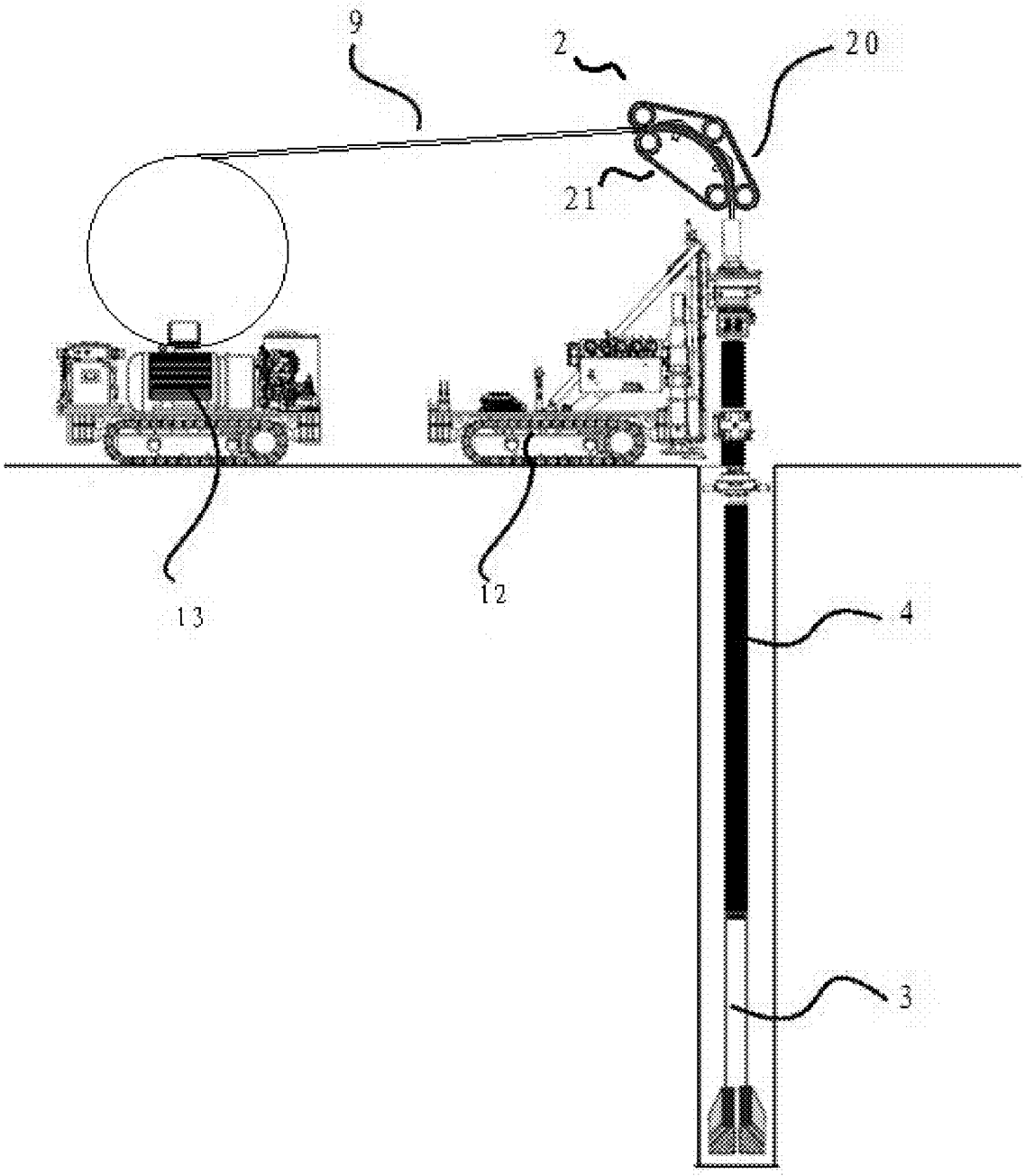
FIG. 10 is a schematic view on coring by using the present application.

A method for core-taking by using the apparatus disclosed by the present application is introduced hereafter, comprising a plurality of following steps:

S1, as shown in FIG. 10, moving the first work trolley 12 to a core-taking position, and moving the second work trolley 13 to a rear of the first work trolley 12, shown as FIG. 3, the folding rack on the first work trolley 12 is folded, to facilitate installing a wellhead equipment;

S2: connecting a drill rod 4 to the outer conduit assembly of a core-taking device 3, and lowering the outer conduit assembly from the ground to the core-taking position gradually;

S3, after assembling the inner conduit assembly of the core-taking device 3 on the ground, extending the continuous conduit 9 into the guiding and injecting integrated mechanism 2 from the reel device 1 through the conduit-arrangement-device-assembly; and connecting the continuous conduit 9 with a center rod of the inner conduit assembly of the core-taking device 3 through a quick connector;

S4, lowering the continuous conduit 9 continuously through a continuous conduit operation device, thereby lowering the inner conduit assembly in the drill rod 4;

S5, starting a drilling machine on ground, to rotate the drill rod driving device 1204 for pressurizing and drilling, now the inner conduit assembly and the outer conduit assembly are matching each other and drilling downwards, so as to start a core-taking work;

S6, during the core-taking operation process, the continuous conduit operation device stops lowering the continuous conduit 9, and keeps a position of the continuous conduit 9 in the drill rod 4 unchanged, the center assembly remains stationary, following a downward movement of both the inner conduit assembly and the outer conduit assembly, a stone core is inserted into a drum;

S7, after a core-taking is finished, starting the reel device 1 and the guiding and injecting integrated mechanism 2, lifting the continuous conduit 9, so as to lift the inner conduit assembly out;

S8, after taking the inner conduit assembly out of the drill rod 4 by the continuous conduit 9, disassembling the quick connector at an end of the continuous conduit 9, and taking out the inner conduit assembly.

Applying the continuous conduit 9 of the present application to lifting up and lowering a pressure maintaining core-taking device, the continuous conduit 9 acts as a role of "rope" in a traditional rope core-taking; further, a hollow structure of the continuous conduit 9 allows a cable to pass through, so as to transmit a measurement and control signal, and by arranging a sensor or a related measurement and control device on the core-taking device, a real time measurement to a target parameter required at a hole bottom is achieved.

Embodiment II

Figure 11:
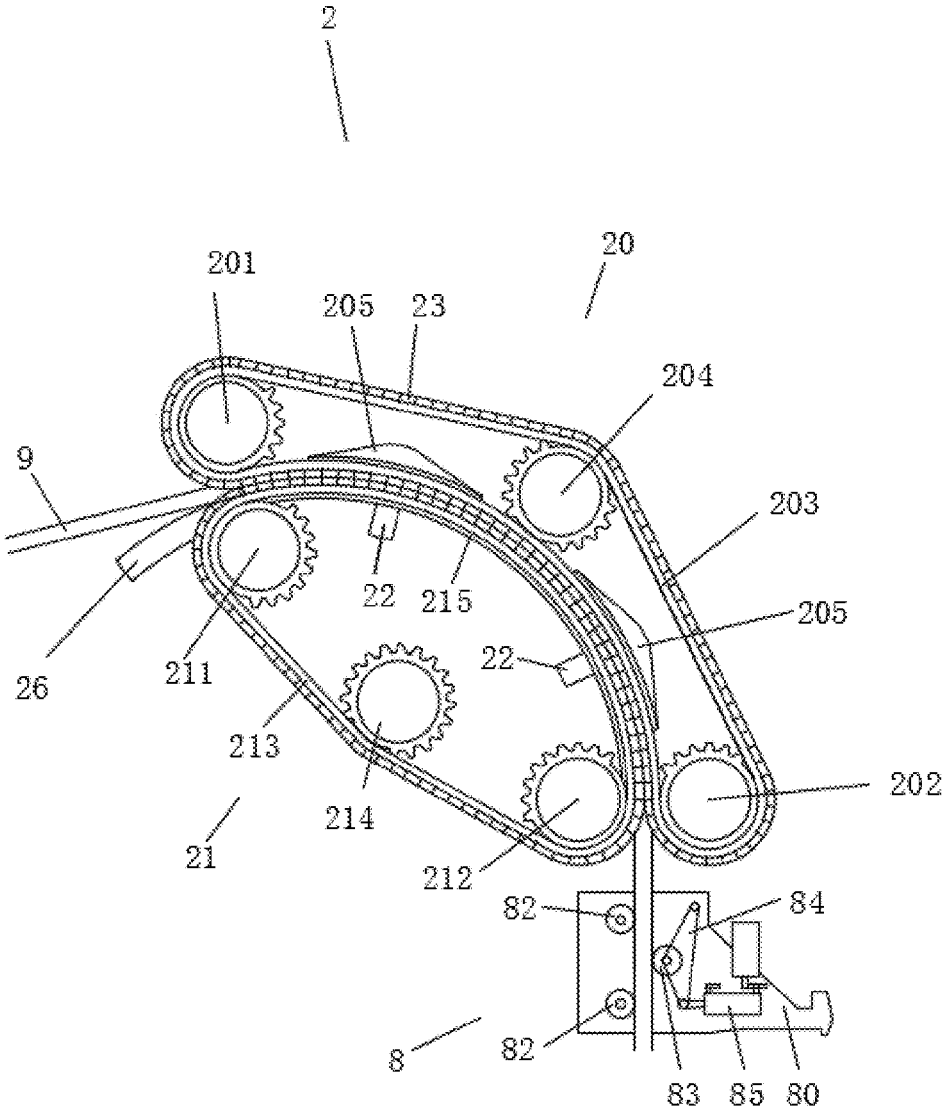
FIG. 11 illustrates a schematic structural diagram on a guide injection integrated mechanism and a straightening device in the Embodiment II.

The difference between the present embodiment and the first embodiment is: as shown in FIG. 11, the second sprocket and chain clamping assembly 21 in the present embodiment further comprises a second tensioning wheel 214 engaged with the second chain 213, and the second driving wheel 211, the second tensioning wheel 214 and the second driven wheel 212 are not in a straight line.

The present embodiment arranges an arc-shaped guide short section 5 at an inlet of the conduit guiding channel, while the arc-shaped guide short section 5 is applied to guiding the continuous conduit 9 to enter the conduit guiding channel more smoothly. The arc-shaped guide short section 5 is concentric with the conduit guiding channel and having a radius equal.

The arc-shaped guide short section 5 locates below the inlet of the conduit guiding channel, and has a certain supporting action to the continuous conduit 9.

Embodiment III

Figure 12:
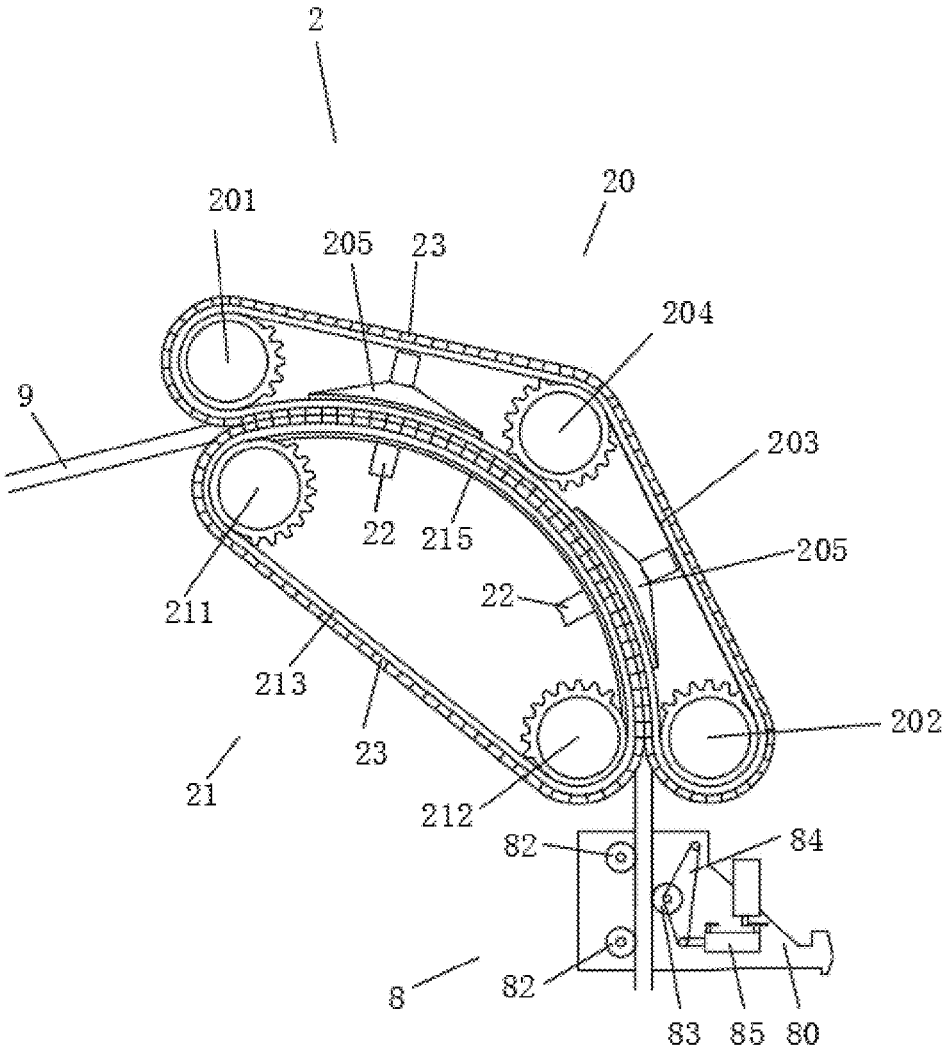
FIG. 12 illustrates a schematic structural diagram on a guide injection integrated mechanism and a straightening device in the Embodiment III.

The difference between the present embodiment and the embodiment I or the embodiment II is: shown as FIG. 12, the first pushing plate 205 in the present embodiment has a clamping driving device 22 arranged, applied to driving the first pushing plate 205 to move in a radial direction.

Embodiment IV

Figure 13:
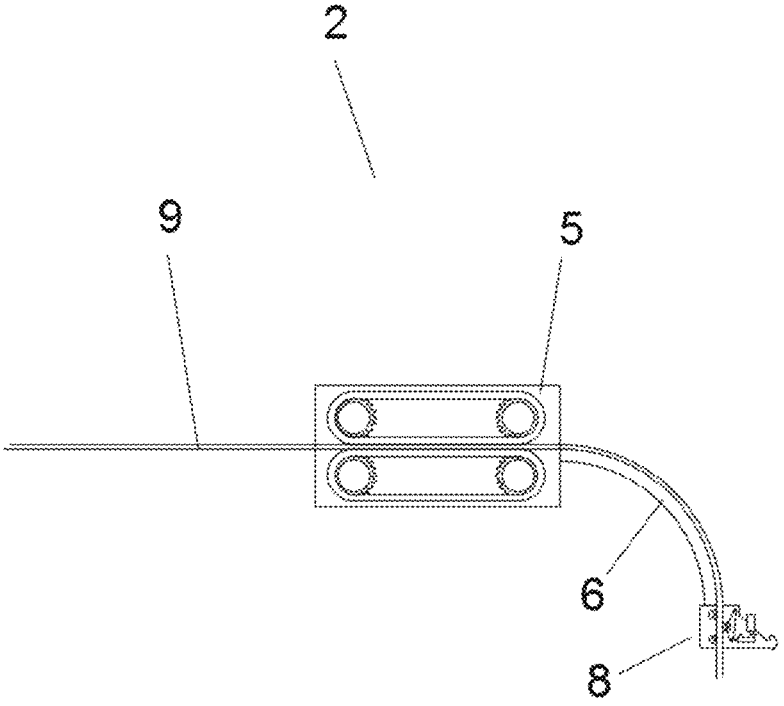
FIG. 13 illustrates a schematic structural diagram on a guide injection integrated mechanism in the Embodiment IV.

The difference between the present embodiment and the embodiment I is: as shown in FIG. 13, the guiding and injecting integrated mechanism 2 in the present embodiment comprises a continuous conduit injection head 5 and a guide arch 6, an inlet and an outlet of the continuous conduit injection head 5 are in a straight line, and the continuous conduit injection head 5 is able to provide a power to drive the continuous conduit 9 to go downwards in a well or upwards in a lifting direction. The present embodiment exchanges a position of the continuous conduit injection head 5 and a position of the guide arch 6 in the prior art, so that the guide arch 6 is applied to guiding the continuous conduit 9 to go down the well. Wherein the guide arch 6 is arc-shaped.

After the positions of the continuous conduit injection head 5 and the guide arch 6 are exchanged, the guide arch 6 guides the continuous conduit 9 to go downwards the well, thus the continuous conduit injection head 5 does not have to be arranged vertically, therefore an overall height of the device can be reduced.

In the present embodiment, the continuous conduit injection head 5 is arranged horizontally, the guide arch 6 is in a quarter arc shape, one end of the guide arch 6 is connected with the continuous conduit injection head 5, another end of the guide arch 6 is downward vertically. Such an arrangement structure is able to minimize an overall height of the continuous conduit injection head 5 and the guide arch 6.

In an operation, the continuous conduit injection head 5 locates between the reel device 1 and the guide arch 6. During an injection, the continuous conduit 9 sent by the continuous conduit injector head 5 is guided into the well by the guide arch 6.

The present embodiment exchanges the positions of the continuous conduit injection head 5 and the guide arch 6, making the continuous conduit injection head 5 no need to be arranged vertically, that is able to lower a height of an equipment effectively.

Similarly, The guide arch 6 is arc-shaped, when inserting the conduit, the continuous conduit 9 undergoes a plastic bending deformation at a position of the guide arch 6, thus the continuous conduit 9 coming out of the guide arch 6 has a residual bend, and after going downwards the well, the residual bend causes the continuous conduit 9 to have an easy eccentricity and abrasion with well wall inside the well, thereby increasing an abrasion in the well.

Thus the present application additionally arranges the straightening device 8 to straighten the continuous conduit 9, so as to eliminate the residual bend of the continuous conduit 9 to a maximum extent, it is guaranteed that the continuous conduit 9 goes vertically downwards the well, being able to relieve the abrasion under the well effectively. The guide arch 6 is arranged between the continuous conduit injection head 5 and the straightening device 8.

Comparing to the prior art, the guiding and injecting integrated mechanism in the present application has a height lowered effectively, which is especially suitable for a working environment having a limited space height, such as working in a mineral hallway.

It should be understood that, the application of the present application is not limited to the above examples listed. Ordinary technical personnel in this field can improve or change the applications according to the above descriptions, all of these improvements and transforms should belong to the scope of protection in the appended claims of the present application.

What is claimed is:

1. A continuous conduit operation apparatus, comprising:

a folding frame; and a guiding and injecting integrated mechanism configured to pull a conduit to go downwards in a well or upwards in a lifting direction, wherein the folding frame comprises a base having a top surface, a mounting frame and a telescopic mechanism configured to rotate the mounting frame in a vertical plane around a position of the movable connection, one end of the mounting frame being connected to the top surface of the base in a movable connection, one end of the telescopic mechanism is movably connected to the top surface of the base, another end of the telescopic mechanism is movably connected to another end of the mounting frame, and the guiding and injecting integrated mechanism is arranged on the another end of the mounting frame.

2. The continuous conduit operation apparatus according to claim 1, further comprising a drill rod driving device, wherein the drill rod driving device is arranged on the mounting frame, and the drill rod driving device is located below the guiding and injecting integrated mechanism.

3. The continuous conduit operation apparatus according to claim 1, wherein the guiding and injecting integrated mechanism comprises a pair of sprocket and chain clamping assemblies, the pair of sprocket and chain clamping assemblies are configured to clamp the conduit and pull the conduit to go downwards in a well or upwards in a lifting direction, between the pair of sprocket and chain clamping assemblies, a conduit guiding channel applied for the conduit to pass through is formed, and an inlet and an outlet of the conduit guiding channel are not situated in a straight line.

4. The continuous conduit operation apparatus according to claim 3, wherein the conduit guiding channel is arc-shaped.

5. The continuous conduit operation apparatus according to claim 4, wherein each of the two sprocket and chain clamping assemblies comprises a sprocket set, a chain, a plurality of clamping blocks mounted on the chain, and a pushing plate configured to press the clamping blocks, the pushing plate is an arc-shaped plate, both pushing plates of the two sprocket and chain clamping assemblies are concentrically arranged; and the pushing plate of at least one sprocket and chain clamping assembly has a clamping driving device connected, the clamping driving device is configured to drive the pushing plate to move in a radial direction, and the pushing plates of the two sprocket and chain clamping assemblies are configured to form the conduit guiding channel between a certain number of the clamping blocks of the two sprocket and chain clamping assemblies, and make the certain number of the clamping blocks of the two sprocket and chain clamping assemblies clamp the conduit.

6. The continuous conduit operation apparatus according to claim 5, wherein a sprocket set of a sprocket and chain clamping assembly located at a periphery comprises a driving wheel, a tensioning wheel, and a driven wheel, and a sprocket set of a sprocket and chain clamping assembly located in an inlier comprises at least a driving wheel and a driven wheel.

7. The continuous conduit operation apparatus according to claim 6, further comprising a straightening apparatus, wherein the straightening apparatus is configured to straighten the continuous conduit.

8. The continuous conduit operation apparatus according to claim 5, further comprising a straightening apparatus, wherein the straightening apparatus is configured to straighten the continuous conduit.

9. The continuous conduit operation apparatus according to claim 4, further comprising a straightening apparatus, wherein the straightening apparatus is configured to straighten the continuous conduit.

10. The continuous conduit operation apparatus according to claim 3, further comprising a straightening apparatus, wherein the straightening apparatus is configured to straighten the continuous conduit.

11. The continuous conduit operation apparatus according to claim 10, wherein the straightening apparatus comprises a bracket, a plurality of first rollers, a second roller, a crank arm, and a pressing hydraulic cylinder, the first rollers are at least two first rollers, and the first rollers are arranged in a straight line, and one end of the crank arm is movably connected to the bracket, the second roller is rotatably mounted at an inflection point of the crank arm, an output end of the pressing hydraulic cylinder is connected to another end of the crank arm to form a straightening channel between the first rollers and the second roller.

12. The continuous conduit operation apparatus according to claim 11, wherein a bottom of the base has a crawler walking mechanism arranged.

13. The continuous conduit operation apparatus according to claim 1, wherein a bottom of the base has a crawler walking mechanism arranged.

14. The continuous conduit operation apparatus according to claim 1, further comprising a reel device, a continuous conduit, and a movable base, wherein the reel device comprises a reel, the reel is installed on a reel frame, the reel frame has a conduit-arrangement-device-assembly arranged, the conduit-arrangement-device-assembly is applied to controlling a winding sequence of the continuous conduit, the reel is driven by a reel motor, and the reel frame is arranged on the movable base.

* * * * *